United States Patent [19]

Mehmert et al.

[11] Patent Number: 4,702,828

[45] Date of Patent: Oct. 27, 1987

[54] DRAIN PIPE ANIMAL GUARD

[75] Inventors: Larry B. Mehmert, Cresco; Irene Huegel, Alta Vista, both of Iowa

[73] Assignee: Togie Corporation, Cresco, Iowa

[21] Appl. No.: 702,619

[22] Filed: Feb. 19, 1985

[51] Int. Cl.[4] ..... B01D 35/02; B01D 33/00

[52] U.S. Cl. ..... 210/131; 210/156; 210/354

[58] Field of Search ..... 210/131, 163, 161, 170, 210/354, 463, 156, 166; 49/58; D23/42; 4/257, 661; 52/101; 172/378, 21, 41

[56] References Cited

U.S. PATENT DOCUMENTS

| | | | |
|---|---|---|---|
| 231,544 | 8/1880 | Darst | 210/131 |
| 233,853 | 11/1880 | Heafer | 210/131 |
| 492,450 | 2/1893 | Williams | 210/354 |
| 597,241 | 1/1898 | Lamb | 210/156 |
| 906,562 | 12/1908 | Rue | 210/463 |
| 955,593 | 4/1910 | Holbrook | 210/354 |
| 961,834 | 6/1910 | Barlett | 210/131 |
| 999,305 | 8/1911 | Gurnett | 210/131 |
| 1,150,348 | 8/1915 | Dreher | 210/156 |
| 1,397,471 | 11/1921 | Walker | 210/131 |
| 1,466,718 | 9/1923 | Holman | 210/131 |
| 2,022,335 | 11/1935 | Bernthal | 172/378 |
| 2,801,512 | 8/1957 | Karaktin | 172/21 |
| 3,289,840 | 12/1966 | Kahn | 210/131 |
| 4,356,087 | 10/1982 | Miles | 210/131 |

FOREIGN PATENT DOCUMENTS

| | | | |
|---|---|---|---|
| 0189477 | 5/1964 | Sweden | 210/161 |

*Primary Examiner*—Richard V. Fisher
*Assistant Examiner*—Linda S. Evans
*Attorney, Agent, or Firm*—Breneman, Georges, Hellwege & Yee

[57] ABSTRACT

A tamper resistant animal guard for a drain pipe outlet having self cleaning prongs for preventing the admission of small animals while allowing sticks, leaves and other debris to flow from a drain pipe is provided by the utilization of a plurality of individually rotatable prongs axially disposed on an axle or shaft. A mounting bracket for mounting the axle or shaft is preferably of a flexible material to conform to the inside circumference of the drain pipe while engaging the ends of the axle or shaft which extends substantially across the diameter of the drain pipe. The individually rotatable pronged wheels are axially spaced from each other with radially spaced prongs extending from the wheels that can rotate clockwise or counterclockwise on the shaft to allow sticks, leaves and other debris to flow out of the pipe at various water discharge rates, while cleaning the prongs and preventing small animals from opening or tampering with the prongs to gain access to the interior of the drain tile, pipe or the like.

17 Claims, 3 Drawing Figures

DRAIN PIPE ANIMAL GUARD

BACKGROUND OF THE INVENTION

1. Field Of The Invention

The present invention pertains to a self cleaning animal guard for preventing animals from gaining access to the interior of a drain pipe while allowing water including leaves, sticks and debris to exit the pipe substantially unimpeded. More particularly, the present invention pertains to a tamper proof animal guard that is self purging, inexpensive to manufacture, readily installed in the field and efficient in allowing water, at various discharge rates which may or may not include debris, to flow freely and unimpeded out of the drain pipe while preventing rodents and other small animals from obtaining entry to the drain pipe. The invention provides a plurality of individually rotatably mounted pronged wheels which are spaced axially and radially at or near the diameter of the discharge outlet of a drain pipe.

2. Description Of The Prior Art

The prior art includes a variety of devices for preventing animals from gaining access to drain pipes while allowing water and debris to flow out of the drain tile or pipe. The prior art employs various covers, gates and animal stops to prevent the entry of small animals such as rodents, muskrats, raccoons, etc. to the interior of the tile or drain pipe. Such small animals generally become lost in the underground drain pipe and die or build nests which thereafter clog the pipe and require digging up of substantial lengths of drain pipe in order to locate and remove the animal or nest to unclog the drain pipe.

The prior art has employed perforated discs and pronged gate assemblies that have been attached to the inside or outside circumference of the drain pipe. Some of the prior art animal gates and perforated plates have been pivotally actuated by debris present in the discharge water. Such prior art animal guards are susceptible to accidentally remain open by debris lodging between the prongs and the sides of the drain pipe. These prior art animal guards have also been known to have been opened by the more intelligent animals such as raccoons. Other prior art employing gates and plates have been pivotally secured to the end of the drain pipe by means of a pin to prevent the opening of the gate by small animals such as raccoons, but such prior art gates and plates periodically require manual opening to remove leaves, sticks and other debris that build up at the animal guard.

Prior art such as Rue U.S. Pat. No. 906,562 and Miles U.S. Pat. No. 4,356,087 are mounted within the open end of the drain pipe and remain in a closed blocking position to prevent small animals from gaining access to the drain pipe. The flow of drain pipe water containing leaves, sticks and other debris results in the pivoting of the gate open in the direction of flow to allow debris to flow out of the drain pipe. These devices are generally eccentrically mounted with respect to the drain pipe and result in the pivoting of one prong or the entire unit of prongs to allow debris to exit the drain tile or pipe without allowing animals to enter the pipe. These prior art animal guards or drain pipe stops do not employ a plurality of individually mounted rotatable prongs that are self cleaning and tamper proof for preventing rodents or other animals such as raccoons from opening the animal guard while allowing debris and water received from the water inlet to flow out of the animal guard.

Prior art such as Kahn U.S. Pat. No. 3,289,840 pertains to a tamper proof animal guard for preventing small animals from gaining access to drain pipe by providing a pivotable gate which remains closed and is manually opened periodically for cleaning to remove built up debris. This approach to the problem of providing a tamper proof guard for preventing admission of small animals into the drain pipe requires periodic cleaning. Other prior art animal guards that provide pivoting gates have not provided a tamper proof system for preventing the admission of more intelligent animals such as raccoons while providing an inexpensive, low maintenance animal guard that is self purging of sticks, paper, leaves, rags and other debris commonly encountered in drain pipe discharge water. In addition, such prior art pivoting gate guards actuated by debris often results in one or more of the eccentrically mounted pivotal prongs becoming stuck in an open position by debris becoming lodged between one or more of the rods or prongs and the drain pipe resulting from changes in water discharge rates or the clogging of the guard with intermediate sized debris.

The prior art has heretofore not provided an efficient self cleaning and animal tamper proof system for allowing drain pipe water and water containing debris to efficiently pass through the animal guard. The prior art has not employed a plurality of individually rotatable wheels utilizing prongs that rotate at different directions and rates under water flow conditions to provide a self cleaning action and prevent entry of the animals into the drain pipe. The problems of the prior art pivotable gates and prongs result in the lodging of debris in the prong which requires cleaning and can keep the prong or guard in a partially opened position to result in further restriction to flow and the possibility the animal guard will not effectively prevent the admission of animals into the drain pipe.

The devices of the prior art have not provided an efficient self cleaning animal guard that is inexpensive to manufacture, readily assembled and attached to drain pipe outlets to prevent animals from gaining admission to the drain pipe while allowing debris in the pipe to flow out of the drain pipe at various discharge rates. The prior art has sought an animal tamper proof guard having a self cleaning gate or prongs to allow debris to flow out of the drain pipe without becoming lodged in the prongs or gate. The prior art has also sought a device which achieves these advantages at varying flow rates that prevents debris from becoming lodged between the prongs and the drain pipe to result in partially open gates or prongs that subsequently allow the entry of animals.

The novel drain pipe animal guard of the present invention provides an effective tamper proof barrier to keep rodents and small animals from entering the drain pipe while allowing debris and other materials to flow out of the animal guard by preventing sticks, leaves and other debris from becoming entangled in the prongs of the independently rotatable pronged wheels. The present invention, in contrast to the prior art, replaces a pivotally mounted prong or gate with a plurality of axially spaced and individually rotatably mounted pronged wheels radially spaced from the circumference of the drain pipe to prevent the admission of rodents and other small animals to provide an effective tamper proof, self cleaning guard for preventing the admission of raccoons or other intelligent small animals. The novel drain pipe animal guard provides an inexpensive, effective and efficient system for preventing the admission of small animals into the drain pipe that is self cleaning under various rates of flow, by allowing the pronged wheels to individually rotate in a clockwise direction at low water outlet discharge rates and rotate counterclockwise or remain substantially stationary at high water outlet discharge rates. The novel drain pipe guard in the present invention, in addition is a tamper proof animal guard that prevents debris from leaving the prongs or gate in a partially opened position by trapped debris that would allow access for small animals.

The present invention further provides installation and operational advantages over the prior art by the utilization of a plurality of individually rotatable pronged wheels that may conveniently be constructed from plastic and mounted on an axle. The ends of the axle may be mounted to a flexible strap for conforming to a portion of the inside circumference of the drain pipe. A mounting bolt can be utilized and a single hole drilled through the wall of the drain pipe for mounting the strap carrying the axle and rotatable pronged wheels inside the drain pipe. The prongs and mounting strap may be formed from aluminum, galvanized steel or preferably formed from a high density polyethylene or plastic to provide advantages of installation and economy over prior art animal guards. The advantages of the invention are augmented by the novel combination of elements which provides a self cleaning, tamper proof animal guard having advantages not heretofore available in the prior art.

SUMMARY OF THE INVENTION

The disadvantages and limitations of prior art animal guards and particularly the problems of clogging and animal tampering with the flow activated pivotal prongs of the prior art animal guards are obviated by the provision of a plurality of axially spaced, individually rotatable pronged wheels disposed substantially at or near the diameter of the drain pipe. The present invention reduces the possibility of clogging by utilizing a plurality of axially and radially spaced individually rotatable prongs responsive to water flow and debris content to individually rotate in a generally clockwise direction at low flow volumes or in a generally counterclockwise direction at high flow volumes. Each individual wheel or prong rotates in response to a stick, leaf or other debris to provide a self purging or cleaning action. The generally clockwise rotation of the pronged wheels provides a self purging action of debris at the bottom half of the drain pipe at low flow rates, while the generally counterclockwise rotation at high flow rate provides a self purging action for debris at the top half of the drain pipe and prevents debris from becoming stuck between the prongs of the wheels and the inside diameter of the top inside circumference of the drain pipe.

The pronged wheels are axially and radially disposed along an axle that may be supported by supporting the axle substantially at the diameter of the drain pipe by drilling a hole at opposite sides of the drain pipe or by providing a flexible support band or strap that may be bent to conform to the inside circumference of the drain pipe. A mounting bolt may be provided in the mounting strap so that a single hole may be drilled through the top of the drain pipe to support the mounting strap and rotatable pronged wheels. The entire assembly is preferably formed from plastic although other materials such as aluminum, galvanized steel and other metallic or non-metallic materials may be employed.

The animal guard of the invention is installed in the drain pipe to provide an effective tamper proof animal guard for preventing small animals from entering drain tile outlets while permitting water, leaves and debris to flow out of the pipe. The individually rotatable, axially spaced and radially disposed prongs on the wheels further serve the function of allowing small debris from becoming clogged in the animal guard and thereby opening the animal guard to animals or subsequently restricting flow. The self purging or cleaning action of the animal guard is achieved by allowing each of the axially disposed wheels to rotate at individual rates in either direction so that when one of the prongs on the wheels contacts leaves, sticks or other debris in the pipe, the other radially spaced prongs on the same wheel and prongs on adjacent wheels can turn to act with the force of the water to remove the debris from the mechanism. The radial spacing of the prongs on the wheel along with the axially adjacent pronged wheels thereby allow obstacles to pass between the prongs and assist in the self cleaning action of the animal guard.

The individually rotatable pronged wheels are axially positioned on the axle to prevent the prongs from contacting the sides of the drain pipe and allow a free rotation of the individual pronged wheels. The wheels preferably each include 6 prongs disposed at an angle of about 60 degrees on the wheel and radially extend to provide a clearance of about 1/16 to ¾ of an inch to the side of the drain pipe and are spaced from about ½ to 1½ inches to each other.

Although other dimensions and arrangements are possible to achieve the self cleaning rodent and animal tamper proof advantages in the preferred application, two pair of pronged wheels having prongs of the same length can be supported near the center of a 6 inch diameter pipe and two smaller wheels having the same prong length can be supported near the sides of the drain pipe. In this manner, the two pronged wheels having prongs of about 2½ inches in length spaced at about 1¼ inches from each other can be rotatably supported at or near the center of the drain pipe and two smaller wheels having prongs of about 1 and ¾ inches in length can be axially disposed next to the large wheels to provide a spacing of about ½ inch to the sides of the drain pipe. The axial spacing between the wheels prevents the wheels from shifting or contacting the sides of the drain pipe. In this manner debris, sticks and leaves do not become lodged between the prongs of the animal guard and the sides of the drain pipe.

The pronged wheels may be spaced from one another on an axle supported at either end directly by the drain pipe or by a flexible strap or support which conforms to the inside circumference of the drain pipe. The axial spacing of the pronged wheels in combination with their rotatability around the axle allows water and debris to flow out of the drain pipe while preventing small animals and rodents from gaining access to the interior of the drain pipe. The support band in the preferred embodiment is flexible to be bent or preshaped into a crescent shaped band to mount the entire assembly inside the drain pipe with a single bolt once a hole is drilled into the drain pipe. The entire assembly in the preferred embodiment is constructed of plastic to provide an effective, low maintenance and inexpensive system for preventing rodents and other small animals from entering drain pipes to build nests, become lodged and subsequently require extensive drain pipe purging or digging operations to unplug the drain pipe. The animal guard of the present invention is tamper proof, self cleaning and does not require substantial maintenance for removing lodged debris from between the prongs and the inside diameter of the drain pipe. The individually rotatable pronged wheels do not contact the surface of the drain pipe and can rotate at individual rates to allow water pressure to force debris from between individually rotatable prongs of the rotatable wheels.

The novel features of the invention provide an efficient, inexpensive and easily installed tamper proof animal guard. The individually rotatable spaced pronged wheels provide a self cleaning action and an effective barrier for preventing rodents and other small animals from entering the drain pipe and insuring against raccoons and other more intelligent animals from tampering with or being able to open the animal guard. As a consequence of its design and construction the invention can be conveniently and inexpensively applied to various sizes of drain pipe from 4 inches to 18 inches and larger to prevent animals from entering the drain pipe while at the same time providing an effective self cleaning device to prevent leaves, sticks and debris from becoming lodged in the prongs of the animal guard.

DESCRIPTION OF THE DRAWINGS

Other advantages of the invention will become apparent to those skilled in the art from the following detailed description of the invention in conjunction with the accompanying drawings in which.

DESCRIPTION OF THE PREFERRED EMBODIMENTS

Figure 1:
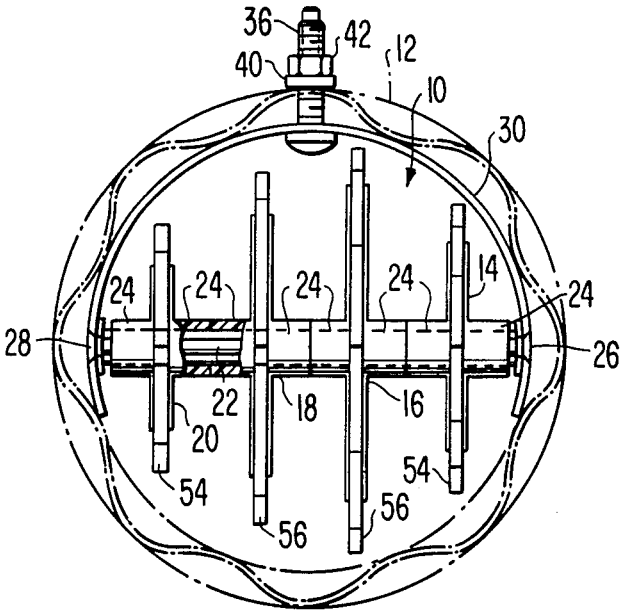
FIG. 1 is a front elevational view partly in section of a drain pipe including an animal guard constructed in accordance with the invention.
Figure 2:
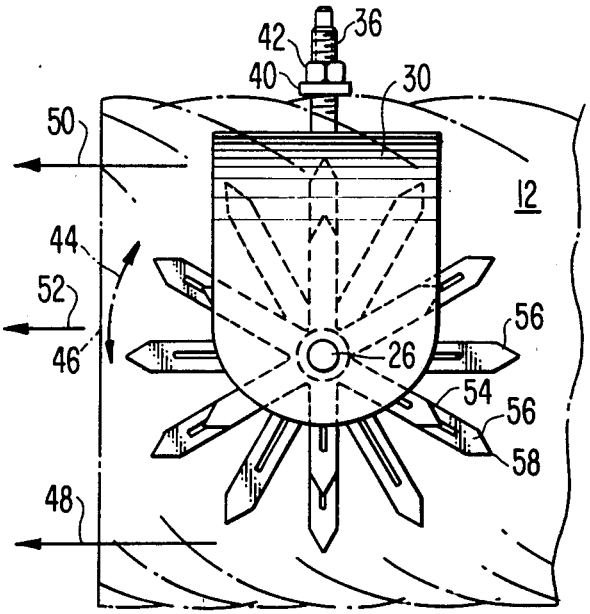
FIG. 2 is a side elevational view of the drain pipe and animal guard of FIG. 1.

Referring now to FIGS. 1 and 2, a drain pipe animal guard 10 constructed in accordance with the invention is illustrated in an operative embodiment in an end section of corrugated drain pipe 12. The novel drain pipe animal guard 10 in the preferred embodiment in a 6 inch in diameter drain pipe 12 includes four individually rotatable pronged wheels 14, 16, 18 and 20 disposed on a shaft or axle 22. The individually rotatable pronged wheels 14, 16, 18 and 20 in the preferred embodiment each includes a spacing element 24 that is integral with the individually rotatable pronged wheels. The spacing element 24 may be manufactured as a separate element for mounting to axle 22 to maintain each of the pronged wheels in their desired axial position with respect to drain pipe 12 and to maintain the radially extending prongs at a fixed distance from the inside circumference of the drain pipe, as will be described hereinafter in greater detail.

The pronged wheels 14, 16, 18 and 20 are each independently rotatably mounted on shaft 22 which may be supported at ends 26 and 28 by a flexible mounting strap or band 30 which conforms to the inside circumference of drain pipe 12. Alternatively, ends 26 and 28 of axle 22 can be lengthened and supported substantially across the diameter of drain pipe 12 by drilling two holes through opposite sides of the wall of the drain pipe 12 and a pair of pins or bolts (not shown) added to fix axle 22 supporting the individually rotatable pronged wheels 14, 16, 18 and 20 across the outlet end of drain pipe 12.

Figure 3:
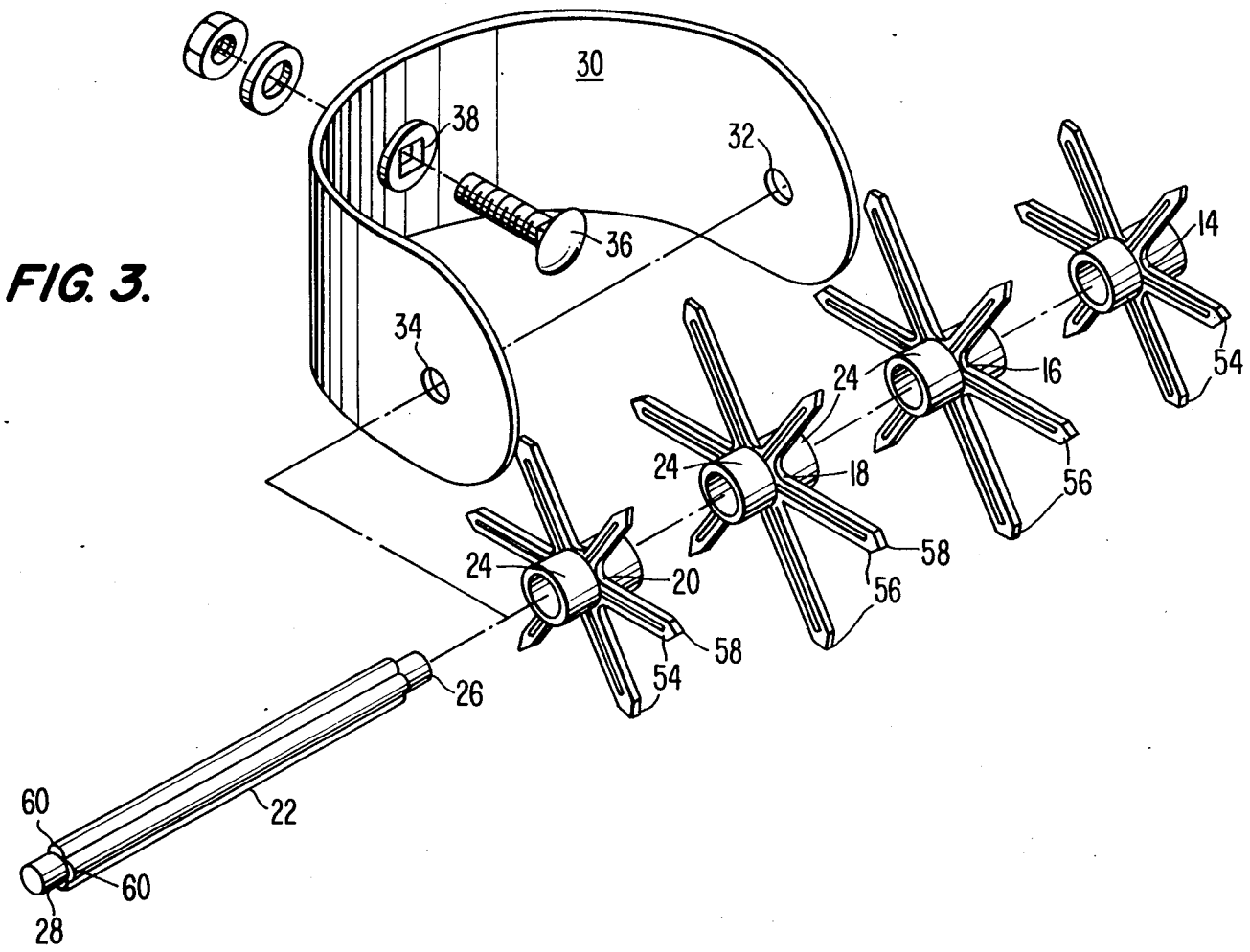
FIG. 3 is an exploded perspective view of the components of a drain pipe animal guard for an arrangement in accordance with one application of the invention.

Referring now to FIGS. 1, 2 and 3 in the preferred embodiment of the invention, a mounting strap or band 30 may be employed to engage ends 26 and 28. Ends 26 and 28 may be tapered to snap into openings 32 and 34 of band 30 to support shaft or axle 22. Pronged wheels 14, 16, 18 and 20 are designed to freely rotate clockwise or counterclockwise within the end of drain pipe 12 without contacting the inside of the circumference of the drain pipe 12. A clearance of about 1/16 to $\frac{3}{4}$ of an inch from the tip of the prong to the inside circumference of the drain pipe is maintained to prevent small animals from gaining access to the interior of the drain pipe and preventing contact between the prongs of the rotatable wheels with the inside circumference of the drain pipe.

The pronged wheels may be spaced from about $\frac{1}{4}$ to $1\frac{3}{4}$ inches from each other and in the preferred application are spaced from about $\frac{1}{2}$ to $1\frac{1}{2}$ inches from each other depending upon the size of the drain pipe and the number of prongs on the pronged wheels, to maintain the desired clearance for preventing the admission of small animals and providing the self cleaning advantages of the invention. The invention is adaptable to all sizes of drain pipe including the 4, 5, 6, 8, 10, 12, 14, 16 and 18 inch diameter pipes in use. As will be understood by those skilled in the art, the number of prongs, angle of the prongs, number of pronged wheels and spacing can be increased or decreased depending upon the particular application of the invention.

The novel drain pipe animal guard 10 in the preferred embodiment is supported in an outlet end of drain pipe 12 by means of the flexible mounting strap or band 30. Flexible mounting strap or band 30 is designed to conform to a portion of the inside circumference of drain pipe 12 while engaging ends 26 and 28 of axle 22 through openings 32 and 34. The flexible mounting strap or band in this embodiment of the invention also allows the drain pipe animal guard 10 to be assembled and shipped as a unit for ease of installation at the drain site. In this embodiment of the invention a single hole is drilled through the top of the drain pipe and a bolt such as machine bolt 36 may be employed with a corresponding square opening 38 in mounting strap or band 30 for attachment to drain pipe 12 with a washer 40 and nut 42.

The novel drain pipe animal guard 10 installed in the drain pipe not only provides a tamper proof animal guard against the more intelligent animals, but also provides a self cleaning or purging device utilizing the hydrostatic pressure of water flowing out of the drain pipe at various flow rates. Each of the individually rotatable pronged wheels is free to rotate clockwise in the direction of arrow 44 or counterclockwise in the direction of arrow 46 (FIG. 2). The independent rotation of the pronged wheels in either direction operates to clean the wheels at varying flow rates.

A low flow rate represented by arrow 48 (FIG. 2) results in a general rotation of the pronged wheels in a clockwise direction as represented by arrow 44. Debris is removed from the rotatable prongs by hydrostatic pressure and radially and axially adjacent rotatable prongs. Conversely, a high flow rate, represented by arrow 50, results in a general rotation of the pronged wheels in a counterclockwise direction, as represented by arrow 46. Debris is removed from the top portion of the drain pipe by hydrostatic pressure and the radially and axially adjacent rotatable prongs. At intermediate flow rates, as represented by arrow 52, the prongs may not rotate until a higher or lower hydrostatic force would result in a cleaning of the mechanism above the diameter or below the diameter of the drain pipe.

The plurality of prongs on the axially disposed rotatable pronged wheels 14, 16, 18 and 20 and their spacing prevents small animals from gaining access to the drain pipe, which in combination with the individual rotatability of the prongs, provides a self cleaning action of the prongs when contacted by debris. In a drain pipe having an inside diameter of about 6 inches a first pair of equally sized pronged wheels 14 and 20 and a second pair of equally sized pronged wheels 16 and 18 each having six equally spaced prongs 54 and 56 respectively (disposed at an angle of about 60 degrees) may be conveniently employed to achieve the advantages of the invention. The six-pronged wheels 14 and 20 and the larger pair of pronged wheels 16 and 18 are axially positioned in the open end of drain pipe 12 by means of spacing elements 24 which in the preferred embodiment of the invention are integrally formed with the pronged wheels.

In an application of the novel drain pipe animal guard to a 6 inch pipe, the two large pronged wheels 16 and 18 are the same size with individual prongs of about 2¼ inches in length or about 5¼ inch from prong to prong across the diameter of the pronged wheel. Pronged wheels 16 and 18 are disposed axially adjacent to each other at a distance of about 1¼ inches by the spacing element 24. Similarly, smaller pronged wheels 14 and 20 are preferably the same size with individual prongs of about 1½ inches in length or about 3 and ¾ inch from prong to prong across the diameter of the smaller pronged wheel. Pronged wheels 16 and 18 are similarly disposed axially adjacent to each other at a distance of about 1¼ inches from pronged wheels 16 and 18 respectively by spacing element 24. The ends of the prongs 54 and 56 may be pointed with a sharp point 58 for further discouraging rodents and other small animals from attempting to gain entry into the drain pipe.

It will be recognized by those skilled in the art that the number of pronged wheels and the angular disposition of the prongs on the wheels may be increased or decreased and the spacing of the pronged wheels in the drain pipe may be modified to suit particular requirements. It will be further appreciated, the angular disposition of the six prongs with respect to shaft or axle 22 may be modified to other than the 90 degrees illustrated in FIG. 3. It will further be recognized that shaft or axle 22 may have a configuration other than a circular cross section as illustrated in FIG. 3, to augment the rotatability of the individually rotatable pronged wheels on the shaft. Shaft or axle 22 in FIG. 3 includes a plurality of rounded projections 60 to reduce frictional forces in the rotation of the pronged wheels.

The novel drain pipe animal guard of the invention achieves its advantages by utilizing a plurality of axially spaced, individually rotatable pronged wheels having radially spaced prongs which, in combination with the axial spacing of the wheels, prevent the admission of small animals while individually rotating to allow sticks, leaves and other debris to exit from the drain pipe. As will be recognized by those skilled in the art, the axial spacing and radial displacement of prongs provide rodent and animal proof tampering while allowing leaves, sticks and other debris to exit the drain pipe. The size of the debris travelling through the pipe is related to the size of the intake or inlet port at the open end of the drain. Consequently, the size and spacing of the prongs is also dependent upon the size of debris travelling through the pipe. The spacing of the prongs axially and the number of prongs disposed radially may be modified by those skilled in the art to suit particular requirements. The advantages of the invention are achieved in employing a plurality of individually rotatable prongs which do not contact the inside circumference of the pipe, which allow a self cleaning action in allowing debris to exit the pipe while preventing more intelligent animals to tamper with the individual prongs to obtain access to the drain pipe.

As will be recognized by those skilled in the art, many mechanical modifications may be made in accordance with the invention to accomplish the advantages of the plurality of individually rotatable pronged elements in drain pipes in accordance with the invention. Animal guards constructed in accordance with the invention can be disassembled and shipped in a flat configuration and thereafter assembled at the work site by mounting the individually rotatable prong elements to an axle or shaft and installed in the drain pipe at the work site. It will be further appreciated that these and other modifications can be made within the spirit and scope of the invention as defined in the following claims.

What is claimed is:

1. An animal guard for drain pipe outlets comprising:

(a) an axle having a length substantially the diameter of a drain pipe and adapted for disposition substantially across the diameter of an outlet means of said pipe;

(b) a plurality of individually rotatable axially spaced wheels, each of said wheels mounted on said axle and having a plurality of radially extending prongs; and (c) means for mounting said axle comprising a flexible band having a means for engaging the ends of said axle.

2. The animal guard for drain pipe outlets of claim 1 wherein each of said wheels is axially spaced from about ¼ to 1 and ¾ of an inch from each other.

3. The animal guard for drain pipe outlets of claim 2 wherein ends of said prongs on each of said wheels are spaced from the inside circumference of said pipe a distance of about 1/16 to ⅜ of an inch.

4. The animal guard for drain pipe outlets of claim 3 wherein each of said wheels includes at least six prongs.

5. A self purging drain pipe animal guard comprising:

(a) a flexible band for conforming to a portion of the circumference of a drain pipe and having means defining shaft mounting holes disposed in the ends thereof;

(b) a shaft having ends for mounting in said shaft mounting holes in said flexible band;

(c) a plurality of individually rotatable wheels, each of said wheels having a plurality of radially extending prongs and including axial spacing means mounted on said shaft; and (d) means for mounting said flexible band in an outlet of a drain pipe wherein said shaft is mounted substantially across the diameter of said drain pipe.

6. The self purging drain pipe animal guard of claim 5 wherein said shaft is of a length substantially equivalent to the diameter of said drain pipe.

7. The self purging drain pipe animal guard of claim 5 wherein each of said wheels has six prongs radially extending from said wheels at an angle of about 60 degrees.

8. The self purging drain pipe animal guard of claim 7 wherein each of said wheels is axially spaced from about 1 inch to 1½ inches from each other.

9. The self purging drain pipe animal guard of claim 8 wherein two of said wheels have prongs of the same length.

10. The self purging drain pipe animal guard of claim 9 wherein each of said wheels having said plurality of radially extending prongs provides a vertical clearance of about 1/16 to ¾ of an inch to the side of said drain pipe.

11. The self purging drain pipe animal guard of claim 9 wherein said shaft is of a cross section other than circular to assist the rotatability of said wheels.

12. The self purging drain pipe animal guard of claim 11 wherein said means for mounting said flexible band in said drain pipe is a bolt.

13. A drain pipe animal guard having self cleaning prongs comprising:

(a) a drain pipe;

(b) a shaft for disposition substantially across the diameter of an outlet means of said drain pipe;

(c) a plurality of axially spaced rotatably mounted wheels, each of said wheels having a plurality of radially extending prongs and mounted on said shaft; and (d) a semicircular flexible mounting strap for mounting and conforming said shaft to a portion of the inside diameter of the outlet of said drain pipe.

14. The drain pipe animal guard having self cleaning prongs of claim 13 wherein each of said axially spaced rotatably mounted wheels is spaced from about ¼ of an inch to 1 and ¾ of an inch from each other.

15. The drain pipe animal guard having self-cleaning prongs of claim 14 wherein each of said wheels includes at least six equally spaced prongs radially extending from said wheels at an angle less than 90 degrees.

16. The drain pipe animal guard having self cleaning prongs of claim 14 wherein said prongs are disposed from about 1/16 to ¾ of an inch from the inside diameter of said drain pipe.

17. The drain pipe animal guard having self cleaning prongs of claim 16 wherein two wheels have prongs of the same length.

* * * * *